United States Patent [19]

Bos

[11] Patent Number: 4,465,012

[45] Date of Patent: Aug. 14, 1984

[54] FLOATING DEVICE FOR TRANSSHIPMENT OF CARGO

[75] Inventor: Robert W. Bos, Leiden, Netherlands

[73] Assignee: Gusto Engineering B.V., Schiedam, Netherlands

[21] Appl. No.: 347,445

[22] Filed: Feb. 9, 1982

[30] Foreign Application Priority Data

Feb. 9, 1981 [NL] Netherlands ..... 8100610

[51] Int. Cl.[3] ..... B65G 67/62

[52] U.S. Cl. ..... 114/266; 114/259; 114/260; 414/144

[58] Field of Search ..... 114/61, 259, 260, 266; 414/144

[56] References Cited

U.S. PATENT DOCUMENTS

| | | | |
|---|---|---|---|
| Re. 28,922 | 8/1976 | Lloyd | 114/61 |
| 2,453,155 | 11/1948 | Nelson et al. | 114/266 |
| 2,532,249 | 11/1950 | Ward | 414/144 |
| 3,009,587 | 11/1961 | Pickrell, Jr. | 414/144 |
| 3,481,296 | 12/1969 | Stephens | 114/61 |

FOREIGN PATENT DOCUMENTS

| | | |
|---|---|---|
| 2419057 | 10/1975 | Fed. Rep. of Germany . |
| 7011013 | 1/1971 | Netherlands . |
| 1580757 | 12/1980 | United Kingdom . |

*Primary Examiner*—Trygve M. Blix
*Assistant Examiner*—Ivy M. Shum
*Attorney, Agent, or Firm*—Young & Thompson

[57] ABSTRACT

A floating device for transshipment of cargo from one ship to another comprises two pontoons (1,2) that are mutually connected and between which space is present for mooring one or more ships, such as barges, and that is adapted to moor alongside another ship, the pontoons supporting one or more structures on which devices are mounted for manipulating cargo, such as hoisting devices. This known device is useful only in quiet water, for instance within the shelter of a harbor. The invention improves the known device in such a manner that it also can be used in exposed places, so that it will be useful in bad weather and may remain in place for instance anchored to a mooring buoy or such. To this end, two pontoons (1,2) have such a small free board that it is swept over during bad weather conditions, the pontoons (1,2) being interconnected by a bow (3) extending higher than the upperdeck (5) of the pontoons.

1 Claim, 4 Drawing Figures

FLOATING DEVICE FOR TRANSSHIPMENT OF CARGO

The invention is related to a floating device for transshipment of cargo from one ship to another ship comprising two pontoons that are mutually connected and between which space is present for mooring one or more ships, such as barges, and provided with means for mooring another ship alongside, said pontoons carrying one or more bridges, on which devices are mounted for manipulating the cargo, such as hoisting devices.

Such a device is for instance known from Dutch Pat. No. 144,226, describing a transshipment device that in particular is suited to transport with the aid of an elevator grain from the hold of a seagoing vessel to several river vessels, that may be present between the pontoons.

In practice moreover a floating transshipment device is known comprising two pontoons that mutually are connected by portals on which transshipment cranes are present with which the cargo from a seagoing vessel can be transported to barges present between the pontoons and the other way around.

These known devices are useful only in quiet water, i.e. within the shelter of a harbour.

The invention aims to provide a floating transshipment device that can be used not only in sheltered places, that also remains useful in case of bad weather and that in even worse weather still may remain in its place for instance by being anchored to a mooring buoy or the like.

According to the invention this aim is achieved by the fact that the two pontoons have such a small freeboard that this can be overswept by the waves under bad weather conditions, both pontoons are mutually connected by a bow extending above the upper deck of the pontoon and each pontoon at one or more places is provided with floating columns that extend far above the upper deck of the pontoon.

The small freeboard means that under bad weather conditions the waves will sweep the deck. With a high freeboard the longitudinal bending moment will increase also when the wave height increases. This is not the case anymore. By the fact that both pontoons are interconnected by means of a high bow, the space between the pontoons will be closed and so kept free in substantial measure from the influence of waves and current. By means of possible anchoring means the device may orient with regard to the direction of wind, waves and current.

The sweeping of the pontoons by high waves is not favourable for the stability of the device. The bow construction with the raised front deck nullifies this negative effect of the low pontoon height in combination with the floating columns extending above the deck of the pontoons. The bow and the columns insure the required stability.

Preferably each pontoon has a cross section that is wide practically as far above as below the water line, after which the wide cross section narrows downwardly into a narrow cross section. This great width of the level of the waves is favourable in connection with the stability when rolling occurs about the longitudinal axis. By making the cross section downwardly narrower it is possible to give the pontoons a draught that is sufficiently great to accommodate barges along their complete draft. A greater width at the water line results in greater wave forces by which the behaviour during moving of the floating device may worsen. The widening offers, besides a good initial stability, space for providing accommodation, shops, machine rooms and pump rooms, etc. By the narrowing downwardly a too great buoyancy is avoided and thus the remarkable effect occurs that such a shape of the frame of the hulls of the pontoons achieves the same advantages as if they were narrow along the whole height.

Preferably the transition between the wide and the narrow section of the pontoon is defined on the outwardly directed wall of the device by a slanting face that forms an acute angle with the horizontal plane. This slanting face of which the angle to horizontal plane preferably is smaller than 60° has a damping influence on the movements of the device. This slanting face can be a flat plane or a smoothly curved surface, for instance according to an S-curve.

According to the invention it is preferred that at the location of the floating column the widths of the section along the complete height of the pontoons to the lower edge of it remains the same. This constant width, that not only extends downwardly but preferably also upwardly in the floating columns provides under all circumstances near the water line sufficient stability and downwardly sufficient strength, in particular in case that at those places hoisting devices are present. It is preferred that one or more pairs of floating columns at the bottom of the pontoons are mutually connected by tubes. These tubes not only form part of that part of the device, that has to provide buoyancy, but they also form the connection between the two pontoons. The floating columns together with this horizontal connection extending from their lower ends form so to say a U-shaped hollow body that mutually connects the pontoons and imparts the required rigidity to the device.

The space between the pontoons further may be open, but it is preferred that the pontoons at the lower ends and in the open space present between the pontoons be mutually coupled by mutually spaced cross beams. These beams have a further reducing effect on the movements of the water between the pontoons, which movements could be the result of pressure oscillations arising at the outer side as a result of the wave effect. These beams need not be structural and remain, as also always is the case with the tubes, outside the reach of the bottom of the barges.

The floating columns preferably form the vertical columns of the bridge or bridges at the upper ends of which the horizontal parts or bridges of the columns are supported and that serve to place thereon the transshipment means as for instance hoisting cranes.

Between these fixedly mounted bridges a bridge can be added that is provided with a silo and that can be mounted movably or can be fixed. This silo is fed by means of the hoisting devices that are bridges mounted on the bridge and in case the portal is movable can be positioned above the hold of the ship to be loaded which ship is present between the pontoons. A supporting construction extending in longitudinal direction can be present for conveying means, such as conveyor belts, to which conveying means coming from the silo are connected. Said conveyor belts may have swingable discharge means at their discharge ends.

U.S. Pat. No. 2,699,321 discloses a floating device for performing drilling operations and for storage of oil comprising two mutually parallel hull parts, interconnected by a bow, which floating device may swivel about a tower that is lowered onto the sea bottom and is anchored to it. The space between the side legs of the pontoons of this known device can be used for receiving ships that have to be loaded or unloaded and also serves for coupling to the tower. This known device is shaped in such a manner that no mooring is possible alongside. The bow and the pontoons have the same height.

The bridge provided with a silo also can be fixedly mounted in which case the cooperation with the conveyor means extending in longitudinal direction, such as conveyor belts, is necessary. However, it is of importance in that case that from the earlier mentioned Dutch Pat. No. 144,226 it is already known to use a bridge with a fixedly mounted silo that cooperates with conveyor means extending in longitudinal direction and that are suited to unload at different spots.

With the aid of the accompanying drawings the invention will now be further elucidated.

FIG. 1 schematically shows a side view of a device according to the invention.

FIG. 2 schematically shows a cross section along the line II—II in FIG. 1 seen from the right hand side.

Figure 1:
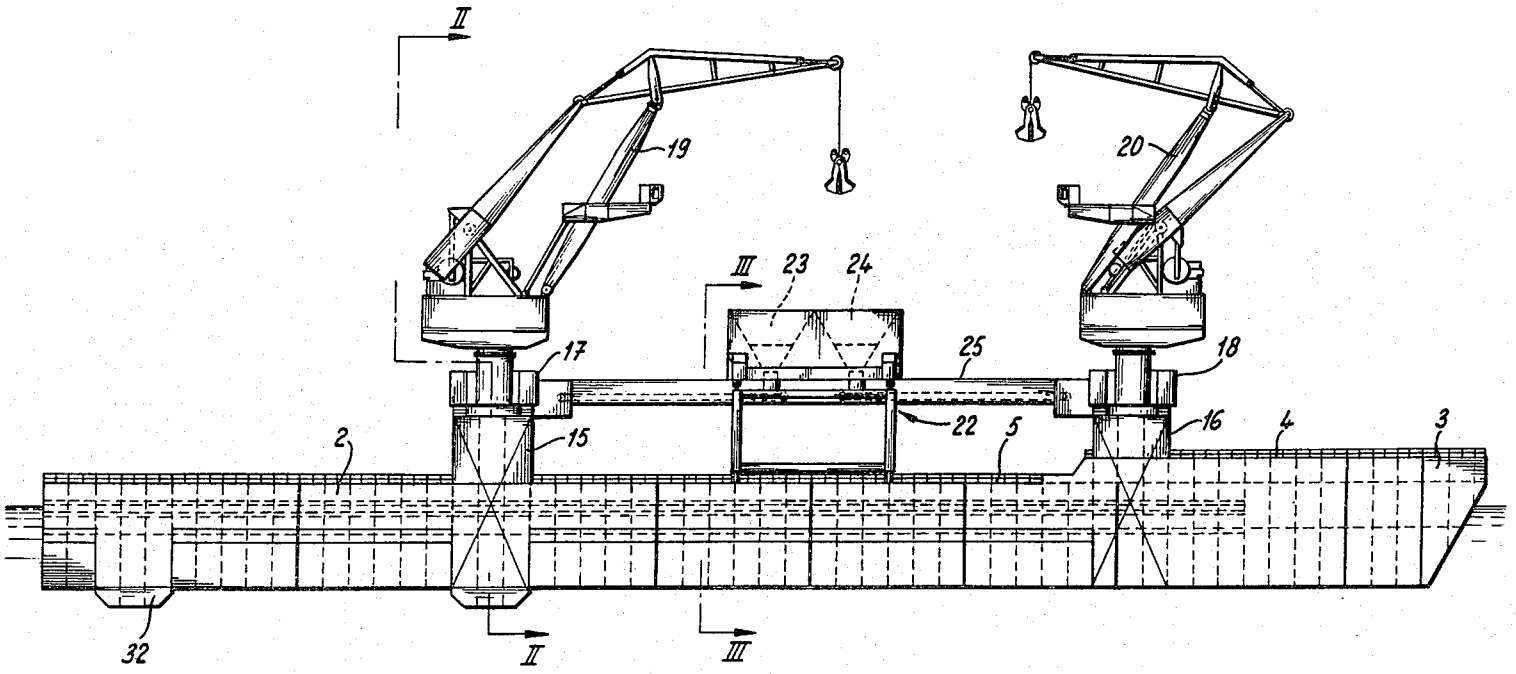

The device shown in the drawing comprises a long slender pontoon 1 and a corresponding pontoon 2 that are mutually connected by a bow 3 of which the upper deck 4 is higher than the upper deck 5 of the pontoons 1 and 2.

Figure 3:
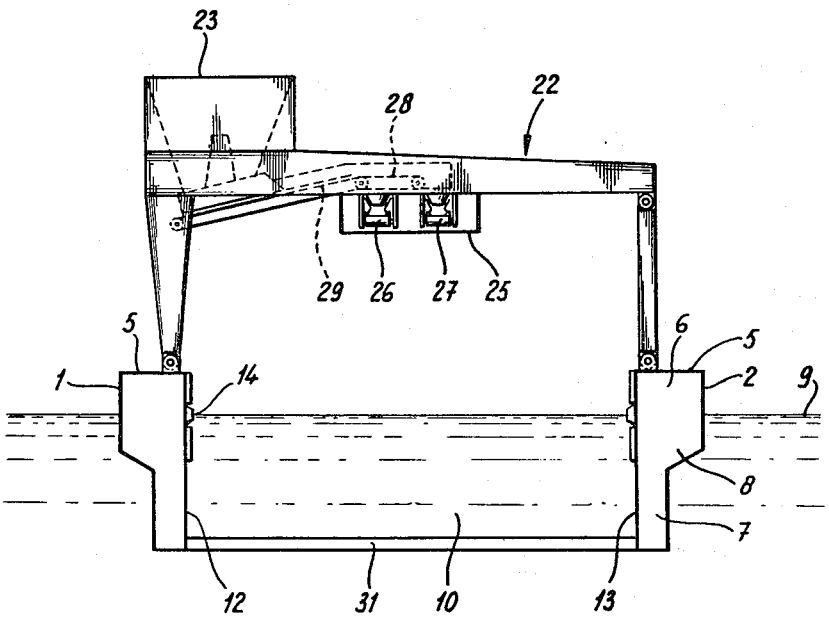
FIG. 3 is a cross section along line III—III in FIG. 1.

The pontoons 1 and 2 have a cross section as shown in FIG. 3 that comprises a wide upper part 6 and a narrow lower part 7, of which the outer wall of the narrow low part 7 merges into the wide upper part 6 through the slanting wall 8. The wide part extends above water and below water practically over the same distance and the free board, which is the distance between the deck 5 and the water surface 9, is relatively small.

Waves will sweep over these pontoons as soon as the waves become too high to be able to manipulate and maintain smaller ships, such as barges, in the space 10 between the pontoons 1 and 2.

The back of the bow is closed by a vertical wall 11 that together with the vertical inner walls 12 and 13 forms the space 10 in which the barges can be moored and for that reason the side walls 12 and 13 among others are provided with fenders or such 14.

Figure 2:
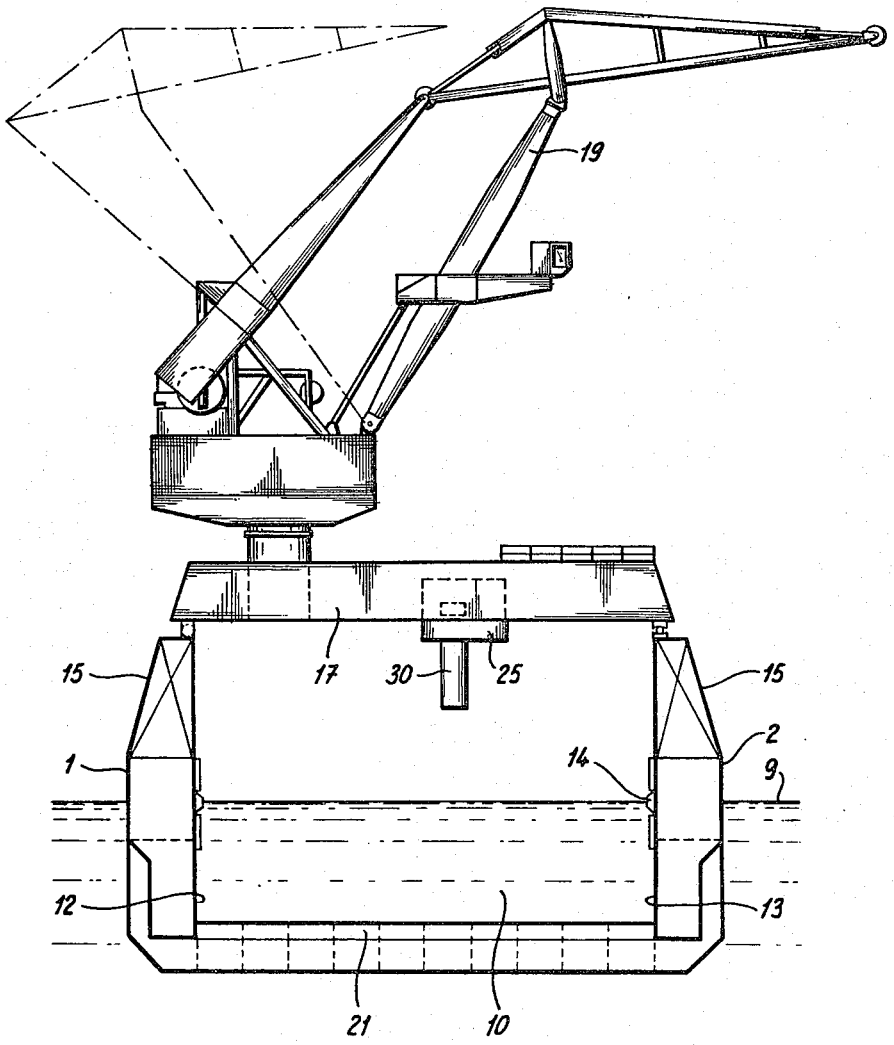
Figure 4:
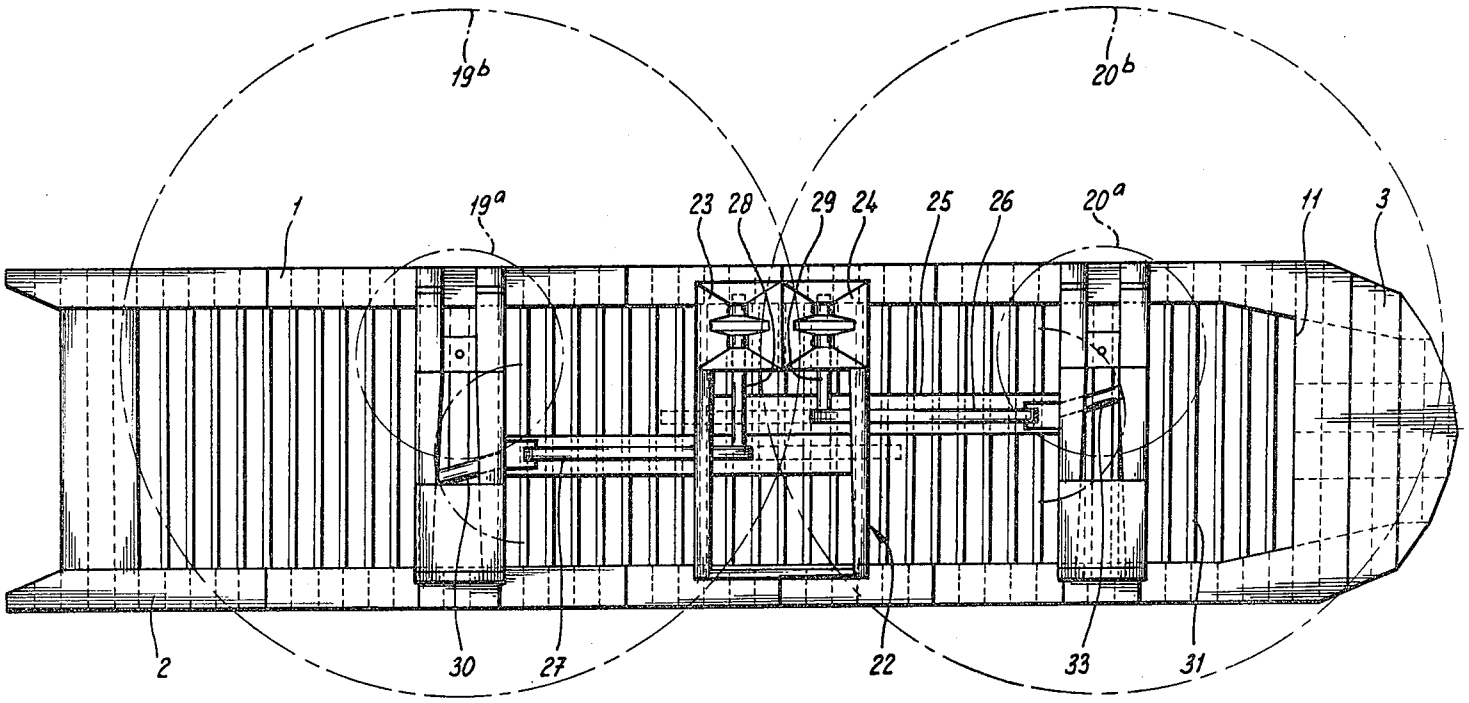
FIG. 4 is a top plan view of the device of FIG. 1 in which hoisting cranes are omitted.

As appears from FIG. 1 the pontoons are at 15 and 16 provided with columns whose shape clearly appears from FIG. 2. These upwardly extending hollow columns provide the required stability when the pontoons 1 and 2 are overswept by waves. Moreover they support the horizontal bridge 17 or beam 18 respectively for the grabbing cranes 19 or 20 respectively which are rotatable about a vertical axis; the working ranges are indicated in FIG. 4 by 19*a*, 19*b* or 20*a*, 20*b* respectively.

It also is possible to use other transshipment devices.

As in particular appears from FIGS. 1 and 2 the pontoons at the floating columns downwardly have the same width that decreases upwardly but also could be equal. At these floating columns the pontoons may be interconnected by tubes 21 as indicated for the floating columns 15 which tubes connect fixedly both pontoons 1 and 2.

The same stiffening without floating columns extending above the deck is provided at the stern.

For the floating columns 16, no tube is necessary for strength and for buoyancy as these floating columns 16 are relatively near the bow 3.

Between both columns 15 and 16 a bridge 22 is present that is shown in FIG. 3 and that in the shown embodiment is fixedly mounted on both upper decks 5 of the pontoons 1 and 2. This bridge 22 supports two silos 23 and 24.

Between the horizontal beams 17 and 18 a support construction 25 is present, in which conveyor belts 26 and 27 are provided having swingable discharge troughs 33 and 30 respectively. In the portal 22 cross conveyors 28, 29 are provided, which connect the silos with the conveyor belts 26, 27.

Also an embodiment is possible preferably with the crane 19 farther backward in which the bridge 22 is movable and can be moved to a most favourable spot above the barge to be loaded.

As appears more in particular from FIGS. 3 and 4 the space 10 between bow and pontoons also can be provided with cross beams 31 between the lower edges of the pontoons, which cross beams mutually are spaced apart and need not to be a part of the strengthening construction of the device. These beams damp the water movements which might occur between the pontoon parts 1 and 2.

The device shown in the drawing can be fixed in a manner not shown to a mooring buoy for which each suitable type can be chosen in which the choice is determined by the local circumstances, such as water depth and the weather conditions to be awaited. This can be a cable connection with a buoy anchored by means of anchor chains, a rigid arm with restricted movability, that is coupled to the buoy anchored to anchor chains or an arm that is pivotally connected to the bow and that is coupled with the connection extending to a bottom anchor and kept under tension by a float.

I claim:

1. In a floating device for transshipment of cargo from one ship to another ship, said device comprising two parallel pontoons which are interconnected by a bow, there being a space between said pontoons for the mooring of ships, said device having cargo handling means; the improvement in which said two pontoons have a freeboard which is lower than the bow, on each pontoon at least one buoyant column which extends upwardly higher than the upper deck of the pontoons and higher than the upper deck of the bow, and a horizontal bridge carried by the upper ends of the buoyant columns that bridges across said space and that is higher than the upper deck of the bow, said cargo handling means being carried by the bridge.

* * * * *